US005853132A

United States Patent [19]

Tsuji

[11] Patent Number: 5,853,132

[45] Date of Patent: Dec. 29, 1998

[54] DISPERSING MACHINE

[75] Inventor: Norimasa Tsuji, Kanagawa, Japan

[73] Assignee: Fuji Photo Film Co., LTD., Kanagawa, Japan

[21] Appl. No.: 812,842

[22] Filed: Mar. 6, 1997

[30] Foreign Application Priority Data

Mar. 6, 1996 [JP] Japan ..... 8-048953
Mar. 7, 1996 [JP] Japan ..... 8-050550

[51] Int. Cl.[6] ..... B02C 17/16

[52] U.S. Cl. ..... 241/172

[58] Field of Search ..... 241/172, 46.17, 241/293, 65, 66, 67; 366/279

[56] References Cited

U.S. PATENT DOCUMENTS 4,174,074 11/1979 Geiger ..... 241/67

FOREIGN PATENT DOCUMENTS 0504836 9/1992 European Pat. Off. ..... 241/172
2312109 9/1974 Germany ..... 241/172
0662066 9/1987 Switzerland ..... 241/172

*Primary Examiner*—Mark Rosenbaum
*Attorney, Agent, or Firm*—Brinks Hofer Gilson & Lione

[57] ABSTRACT

A dispersing machine 1 comprises a fixed vessel 3, an agitator shaft 5 rotating at a high speed in the fixed vessel, agitating pins 7 provided to project on an outer circumferential surface of the agitator shaft and an inner circumferential surface of the fixed vessel, and balls B loaded in the fixed vessel in advance, whereby materials supplied into the fixed vessel so as to be treated are dispersed and mixed by agitation by means of the balls and the agitating pins, wherein each of the agitating pins 7 includes a stud bolt 42 and a pin body 44 which is made of a sintered hard alloy shaped into a capitate cylinder, dispersed so as to cover the stud bolt, and fixed to the stud bolt by soldering, pin fitting holes 51 are formed through a wall portion of the fixed vessel so that skirt portions 45 of the respective pin bodies of the agitating pins are fitted into the pin fitting holes, and box nut members 30 are fixed to an outer circumferential surface of the wall portion in positions corresponding to the pin fitting holes so that the stud bolts are screwed down to the nuts, and at least the agitating pins provided to project on the inner circumferential surface of the fixed vessel are attached so that skirt portions of the respective pin bodies of the pins are buried in the pin fitting holes.

11 Claims, 4 Drawing Sheets

DISPERSING MACHINE

BACKGROUND OF THE INVENTION

The present invention relates to a dispersing machine, and particularly to the improvement of agitating pins of a dispersing machine provided so as to project on at least one of the outer circumferential surface of an agitator shaft and the inner circumferential surface of a fixed vessel to thereby disperse and mix materials to be treated which are supplied into the fixed vessel.

DESCRIPTION OF THE RELATED ART

FIG. 4 is a schematic configuration view illustrating a main portion of a dispersing machine 1 for dispersing and mixing materials to be treated.

This illustrated dispersing machine 1, so called a horizontal sand grinder, is constituted by a cylindrical fixed vessel 3 which has a horizontally-directed central axis (a), an agitator shaft 5 which rotates at a high speed in the fixed vessel 3, a large number of agitating pins 22 which are provided to project on the inner circumferential surface of the fixed vessel 3 and on the outer circumferential surface of the agitator shaft 5, and balls (not-shown) such as glass beads, steel balls or the like loaded in the fixed vessel 3 in advance. Materials to be treated which are supplied into the fixed vessel 3 are dispersed and mixed through agitation by means of the balls and the agitating pins 22.

Since heat is generated in the materials to be treated which are dispersed and mixed by such a dispersing machine 1, each of the fixed vessel 3 and the agitator shaft 5 has a jacket structure for circulating cooling water in order to control the temperature of the materials to be treated.

The jacket structure of the fixed vessel 3 is constituted by a vessel outer cylinder 23 and a vessel inner cylinder 24. Cooling water supplied from a cooling water inlet 9 provided in the lower portion of the vessel outer cylinder 23 is circulated through a channel formed between the vessel outer cylinders 23 and the vessel inner cylinders 24, and exhausted from a cooling water outlet 11 provided in the upper portion of the vessel outer cylinder 23.

As well as the jacket structure of the fixed vessel 3, the agitator shaft 5 has a double cylinder structure constituted by an inner cylinder 14 and an outer cylinder 15. Cooling water, which is supplied into the inner cylinder 14 from a cooling water inlet 13 provided on the support end side of the rotation axis, flows in the inner cylinder 14 to the free end side, moves at the free end side into a gap G between the inner cylinder 14 and the outer cylinder 15 through openings 14*a* formed on the free end side of the inner cylinder 14, returns to the support end side through the gap G between the inner cylinder 14 and the outer cylinder 15, and then exhausted from a cooling water outlet 17.

The materials to be treated, which are supplied into the fixed vessel 3 from a material inlet 19 provided on the free end side of the fixed vessel 3 are sent to the support end side of the fixed vessel 3 while they are being dispersed and mixed in the fixed vessel 3, and then discharged from a material outlet 20 provided on the support end side of the fixed vessel 3.

The agitating pins 22 used in such a dispersing machine 1 repeat violent collisions with the supplied materials to be treated and with the balls loaded in the fixed vessel 3 to accelerate dispersing and mixing. Accordingly, the agitating pins 22 are required to have high abrasion resistance.

Therefore, as shown in FIG. 5, each agitating pin 22 of the dispersing machine is constituted by a stud bolt 26 planted in, for example, the inner circumferential surface of the vessel inner cylinder 24 of the fixed vessel 3, and a pin body 28 made of a sintered hard alloy which is shaped into a capitate cylinder, and provided so as to cover the stud bolt 26.

A thread portion 29 formed at one end of the stud bolt 26 is inserted through a pin fitting hole 25 of the vessel inner cylinder 24, and screwed down to a nut 30 welded on the outer circumferential surface of the vessel inner cylinder 24, so that the stud bolt 26 is fixed to the inner circumferential surface of the vessel inner cylinder 24.

On the other hand, since the pin body 28 made of a sintered hard alloy cannot be threaded, the other end side of the stud bolt 26 crowned with the pin body 28 is made to be a simple column with no thread portion. The pin body 28 is fixed to the other end of the stud bolt 26 by a spring pin 32 which is fittingly inserted into the stud bolt 26 through a spring pin insertion hole 33 bored in the side surface of the pin body 28.

The diameter of the pin fitting hole 25 is set to a value larger than the outer diameter of the thread portion 29 bound at the one end of the stud bolt 26, and smaller than the outer diameter of a skirt portion (lower end portion) 27 of the pin body 28. As a result, the pin body 28 is made to stand on the inner circumferential surface of the vessel inner cylinder 24.

However, in such a structure of the agitating pin 22, there has been a problem that stress concentration arises in the spring pin insertion hole 33 bored in the pin body 28 so as to receive the spring pin 32 inserted thereto, and such a crack as shown in FIG. 6 is apt to be produced to thereby cause a damage on the agitating pin 22. Such a damage is caused on the agitating pin 22, fragments of the pin 22 may be mixed into materials to be treated to make the products defective.

In addition, in such a dispersing machine 1 as mentioned above, abrasion due to rubbing with the balls and materials to be treated both loaded in the fixed vessel 3 occurs in the inner circumferential surface of the vessel inner cylinder 24 as well as in the outer circumferential surface of the agitator shaft 5. Therefore, the wall portions of the vessel inner cylinder 24 and the wall portion of the agitator shaft 5 are made thick enough so as not to be bored easily by abrasion. However, in the conventional structure where each agitating pin 22 is attached as shown in FIG. 5, if the inner circumferential surface of the vessel inner cylinder 24 is abraded due to rubbing with the balls and materials to be treated both loaded in the fixed vessel 3 as shown in FIG. 7, a space S1 is produced between the skirt portion 27 of the pin body 28 and the inner circumferential surface of the vessel inner cylinder 24 so that a part of the stud bolt 26 is exposed to a space where the materials to be treated are dispersed and mixed. Thus, there has been a fear of producing such a disadvantage that the stud bolt 26 is abraded and broken before the pin body 28 made of a sintered hard alloy or the vessel inner cylinder 24 is exhausted by abrasion.

SUMMARY OF THE INVENTION

It is therefore an object of the present invention to solve the foregoing problems to thereby provide a dispersing machine having agitating pins which can prevent stress concentration into pin bodies made of a sintered hard alloy, and have no fear of breaking.

It is another object of the invention to solve the foregoing problems to thereby provide a dispersing machine having agitating pins in which even if abrasion is progressed in the inner circumferential surface of a fixed vessel, there is no fear that any part of each stud bolt planted in the wall portion of the fixed vessel is exposed into a space where materials to be treated are dispersed and mixed, so that the dispersing machine can be used continuously for a long time.

The foregoing first object of the present invention are achieved by a dispersing machine which comprises a fixed vessel, an agitator shaft rotating at a high speed in the fixed vessel, agitating pins provided to project on at least one of an outer circumferential surface of the agitator shaft and an inner circumferential surface of the fixed vessel, and balls loaded in the fixed vessel in advance, whereby materials supplied into the fixed vessel so as to be treated are dispersed and mixed by agitation by means of the balls and the agitating pins, wherein each of the agitating pins includes a stud bolt planted in at least one of the outer circumferential surface of the agitator shaft and the inner circumferential surface of the fixed vessel, and a pin body which is made of a sintered hard alloy, shaped into a capitate cylinder, and disposed so as to cover the stud bolt, the pin body being fixed to the stud bolt by soldering.

According to the above-mentioned structure, the pin body made of a sintered hard alloy is fixed to the stud bolt by soldering, so that such a spring pin insertion hole which may cause stress concentration can be excluded from the pin body.

In addition, welding metal used for the soldering fills up the gap between the pin body and the stud bolt, so that there is no fear that any looseness is caused between the pin body and the stud bolt by the impact due to collision with the balls and materials to be treated both loaded in the fixed vessel.

Further, the foregoing second object of the present invention is achieved by a dispersing machine which comprises fixed vessel, an agitator shaft rotating at a high speed in the fixed vessel, agitating pins provided to project on both an outer circumferential surface of the agitator shaft and an inner circumferential surface of the fixed vessel, and balls loaded in the fixed vessel in advance, whereby materials supplied into the fixed vessel to be treated are dispersed and mixed by agitation by means of the balls and the agitating pins, wherein each of the agitating pins includes a stud bolt and a pin body which is made of a sintered hard alloy shaped into a capitate cylinder, and dispersed so as to cover the stud bolt, pin fitting holes are formed through a wall portion of the fixed vessel so that skirt portions of the respective pin bodies of the agitating pins are fitted into the pin fitting holes, and box nut members are fixed to an outer circumferential surface of the wall portion in positions corresponding to the pin fitting holes so that the stud bolts are screwed down to the nuts, and at least the agitating pins provided to project on the inner circumferential surface of the fixed vessel are attached so that skirt portions of the respective pin bodies of the pins are buried in the pin fitting holes.

According to the above-mentioned structure of the present invention, each of the agitating pins provided so as to project on the inner circumferential surface of the fixed vessel is attached in a manner so that the skirt portion of the pin body which is made of a sintered hard alloy and which is provided so as to cover the stud bolt is buried in the wall portion of the fixed vessel on which the stud bolt is planted. Accordingly, even if abrasion is progressed in the inner circumferential surface of the fixed vessel due to rubbing with the balls and materials to be treated both loaded in the fixed vessel, the stud bolt is kept covered with the pin body made of a sintered hard alloy.

DETAILED DESCRIPTION OF THE PREFERRED EMBODIMENT

An embodiment of the present invention will be described below in detail with reference to FIGS. 1 and 2 of the accompanying drawings.

Figure 1:
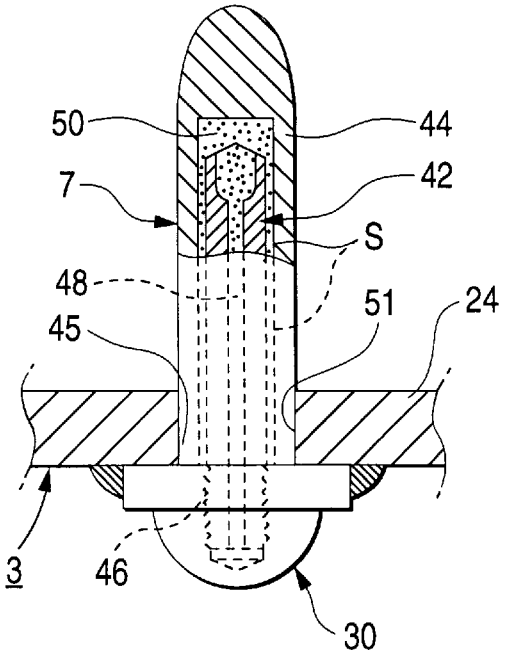
FIG. 1 is a partially broken view illustrating an agitating pin attached to a dispersing machine according to an embodiment of the present invention.
Figure 2:
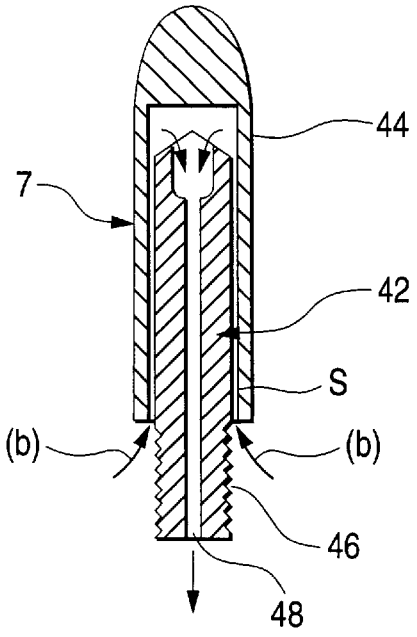
FIG. 2 is a vertically sectional view for explaining a method of producing the agitating pin shown in FIG. 1.

FIG. 1 is a partially broken view illustrating an agitating pin attached to a dispersing machine according to an embodiment of the present invention, and FIG. 2 is a longitudinally sectional view for explaining a method of producing the agitating pin shown in FIG. 1.

Figure 4:
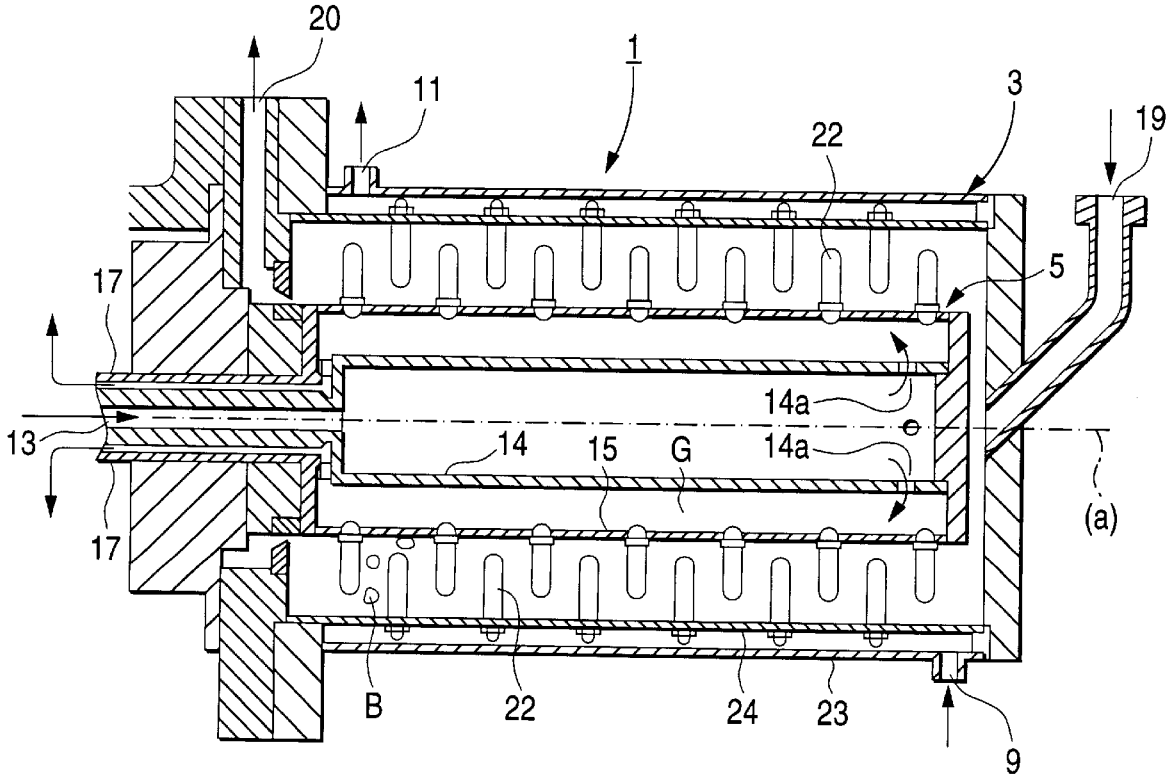
FIG. 4 is a schematic structure view illustrating a main portion of a dispersing machine.
Figure 5:
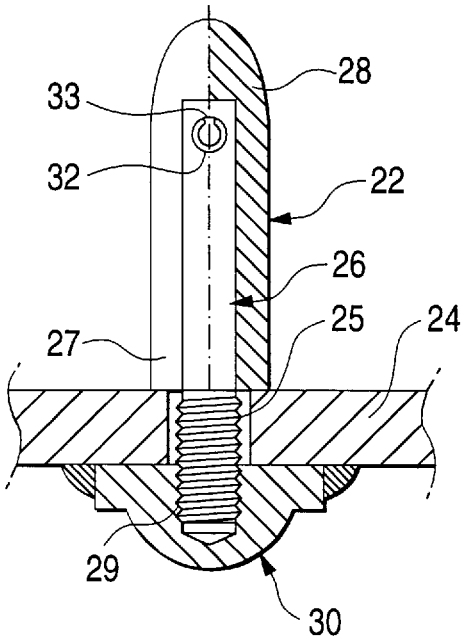
FIG. 5 PRIOR ART
FIG. 5 is a main portion sectional view illustrating a conventional structure of attachment of an agitating pin.
Figure 6:
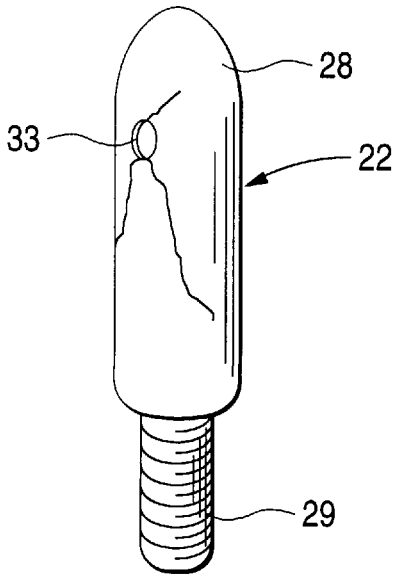
FIG. 6 PRIOR ART
FIG. 6 is a whole perspective view for explaining problems in the agitating pin shown in FIG. 5.
Figure 7:
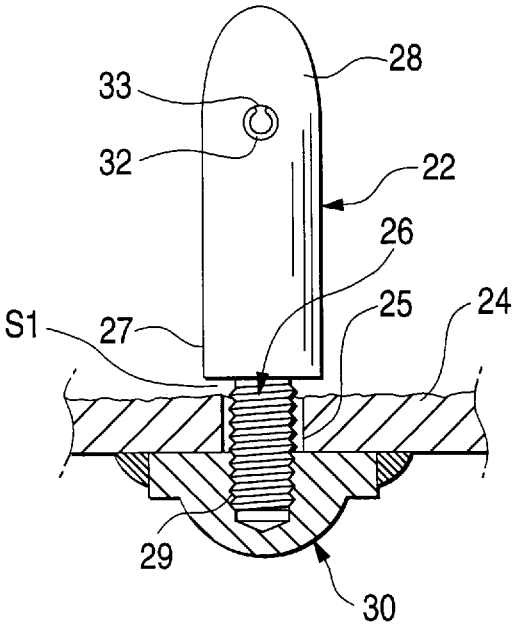
FIG. 7 PRIOR ART
FIG. 7 is a main portion sectional view for explaining problems in the conventional structure of attachment of the agitating pin shown in FIG. 5.

An agitating pin 7 in this embodiment is mounted on a fixed vessel 3 or an agitator shaft 5 of a dispersing machine similarly to the agitating pin 22 shown in FIG. 4. Since the whole structure of the dispersing machine is similar to that of the dispersing machine 1 shown in FIG. 4, the detailed description about them will be omitted here.

The agitating pin 7 is constituted by a stud bolt 42 planted, for example, on a vessel inner cylinder 24 of the fixed vessel 3, and a pin body 44 made of a sintered hard alloy which is shaped into a capitate cylinder, and provided so as to cover the other end portion of the stud bolt 42.

A thread portion 46 formed at one end of the stud bolt 42 is screwed down to a nut 30 welded on, for example, the outer circumferential surface of the vessel inner cylinder 24, so that the stud bolt 42 is fixed to the vessel inner cylinder 24 as shown in FIG. 1. In this embodiment, a well-known box nut is used as the nut 30.

On the other hand, the other end of the stud bolt 42 crowned with the pin body 44 is made to be a simple column, and its outer diameter is set so as to form an enough space S between the stud bolt 42 and the pin body 44 so as to make melted metal (soldering material) flow through the space.

At the center of the stud bolt 42, a suction hole 48 for sucking melted metal injected to the space S is formed through the stud bolt 42 along the center axis thereof.

That is, suction is made through a desired suction means connected to the suction hole 48 of the stud bolt 42 so that melted metal 50 is injected from the space S which is opened in the skirt side of the stud bolt 42 as indicated by the arrow (b) in FIG. 2. Thus, the pin body 44 is soldered and fixed to the other end of the stud bolt 42 by the solidification of the injected melted metal 50.

Therefore, the stud bolt 42 is formed of not a sintered hard alloy but a metal material for a general structure. In order to solder the stud bolt 42 relative to the pin body 44, it is preferable to use a metal material having thermal expansion characteristics equivalent to those of the sintered hard alloy of the pin body 44. As the soldering material used in this embodiment, it is possible to use various materials, such as silver solder, brass solder, phosphor bronze solder, and other hard solders.

In the dispersing machine using such agitating pins 7 as mentioned above, the pin body 44 made of a sintered hard alloy is fixed to the stud bolt 42 by soldering, so that a spring pin insertion hole which has been a cause of stress concentration can be excluded from the pin body 44.

In addition, the melted metal 50 used for the soldering fills up the space S between the pin body 44 and the stud bolt 42, so that there is no fear that any looseness is generated between the pin body 44 and the stud bolt 42 due to the impact caused by collision with the balls and materials to be treated both loaded in the fixed vessel 3.

It is therefore possible to prevent cracks from being produced by stress concentration in the pin body 44 made of a sintered hard alloy to make the agitating pin 7 broken and to thereby make the pin body 44 exhaust its life-time by abrasion. Thus, the reliability in its designed life-time can be make higher.

The agitating pin of a dispersing machine according to the present invention is not limited to the structure of the agitating pin 7 in the above embodiment, but, not to say, may be modified variously on the basis of the gist of the invention.

For example, in the case where the agitating pin 7 is planted in the vessel inner cylinder 24 of the fixed vessel 3 in the above embodiment, the stud bolt 42 is fixed to the vessel inner cylinder 24 by means of the nut 30 as mentioned above. But the way of fitting the agitating pin is not limited to means by use of such a nut. Not to say, the agitating pin 7 may be planted in the outer cylinder 15 of the agitator shaft 5.

A structure of attachment of an agitating pin according to the present invention will be described in detail hereinafter.

As described before, FIG. 1 is a partially broken view illustrating the structure of attachment of an agitating pin according to the present invention. In addition to this, FIG. 3 is a main portion sectional view illustrating the state where abrasion is progressed around the agitating pin of FIG. 1.

As shown in FIG. 1, a pin fitting hole 51 to which a skirt portion 45 of the pin body 44 can be fitted is formed through the vessel inner cylinder 24 of the fixed vessel 3, and a nut 30 is fixedly welded to the outer circumferential surface of the vessel inner cylinder 24 correspondingly to the position of the pin fitting hole 51.

Consequently, the agitating pin 7 provided so as to project on the vessel inner cylinder 24 of the fixed vessel 3 is attached to the vessel inner cylinder 24 in a manner so that the skirt portion 45 of the pin body 44 is buried in the pin fitting hole 51.

Figure 3:
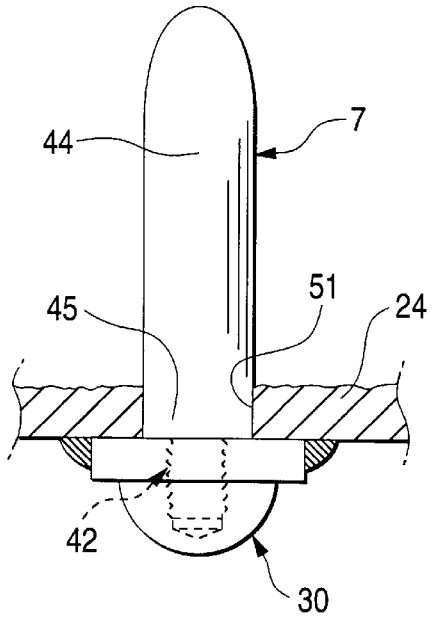
FIG. 3 is a main portion sectional view illustrating the state where abrasion is progressed around the agitating pin shown in FIG. 1.

In the dispersing machine in which the agitating pin 7 is attached as mentioned above, even if the abrasion of the inner circumferential surface of the vessel inner cylinder 24 is progressed, as shown in FIG. 3, by rubbing with the balls and materials to be treated both loaded in the fixed vessel 3, the stud bolt 42 is kept covered with the pin body 44 made of a sintered hard alloy, so that there is no fear that any part of the stud bolt 42 is exposed into a space where the materials to be treated are dispersed and mixed.

It is therefore possible to prevent such a trouble that the stud bolt 42 is abraded and broken before the vessel inner cylinder 24 of the fixed vessel 3 is exhausted by abrasion, so that the dispersing machine can be used continuously for a longer time.

In this embodiment, the pin fitting hole 51 is made to be a simple hole which penetrates the vessel inner cylinder 24 from its inner surface to its outer surface with the same diameter, and the pin body 44 is buried so that its skirt portion 45 contacts with the box nut 30. Alternatively, the pin fitting hole 51 may be a stepped spot-facing hole so that the skirt portion 45 is buried to the intermediate of the plate thickness of the vessel inner cylinder 24.

Further, the form of the dispersing machine is not limited to a horizontal sand grinder, but the present invention is applicable to any other forms of dispersing machines, such as a vertical sand grinder and so on.

As has been described above, according to a dispersing machine of the embodiment of the present invention, a pin body made of a sintered hard alloy is fixed to a stud bolt by soldering, so that a spring pin insertion hole which has caused stress concentration can be excluded from the pin body.

In addition, since melted metal used as the soldering fills up a space between the pin body and the stud bolt, there is no fear of occurrence of looseness between the pin body and the stud bolt by the impact due to collision with balls or materials to be treated in a foxed vessel.

It is therefore possible to provide a dispersing machine having superior agitating pins in each of which stress concentration can be prevented from occurring in the pin body of a sintered hard alloy so that there is no fear of breaking of the pins.

In addition, as mentioned above, according to a dispersing machine of the embodiment of the present invention, each of agitating pins provided so as to project on a wall portion of a fixed vessel is attached such that a skirt portion of a pin body made of sintered hard alloy and disposed so as to cover a stud bolt is buried in a wall portion of the fixed vessel where the stud bolt is to be set up. Accordingly, even if abrasion of the inner circumferential surface of the fixed vessel is progressed by rubbing with the balls and materials to be treated both loaded in the fixed vessel, the stud bolt is kept covered with the pin body of a sintered hard alloy, and there is no fear that any part of the stud bolt is exposed into a space where the materials to be treated are dispersed and mixed.

It is therefore possible to prevent such a trouble that the stud bolt is abraded and broken before the inner circumferential surface of the fixed vessel is exhausted by abrasion. Accordingly, it is possible to provide a dispersing machine having agitating pins which can be used continuously for a longer time.

The foregoing description of a preferred embodiment of the invention has been presented for purposes of illustration and description. It is not intended to be exhaustive or to limit the invention to the precise from disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A dispersing machine comprising a fixed vessel, an agitator shaft rotating at a high speed in said fixed vessel, agitating pins provided to project on at least one of an outer circumferential surface of said agitator shaft and an inner circumferential surface of said fixed vessel, and balls loaded in said fixed vessel in advance, whereby materials supplied into said fixed vessel so as to be treated are dispersed and mixed by agitation by means of said balls and said agitating pins, wherein each of said agitating pins includes:

a stud bolt planted in at least one of the outer circumferential surface of said agitator shaft and the inner circumferential surface of said fixed vessel; and a pin body which is made of a sintered hard alloy, shaped into a capitate cylinder, and disposed so as to cover said stud bolt, said pin body being fixed to said stud bolt by soldering.

2. The dispersing machine according to claim 1, wherein:

pin fitting holes are formed through a wall portion of said fixed vessel so that skirt portions of the respective pin bodies of said agitating pins are fitted into said pin fitting holes;

box nut members are fixed to an outer circumferential surface of said wall portion in positions corresponding to said pin fitting holes so that said stud bolts are screwed down to said nuts; and at least said agitating pins provided to project on the inner circumferential surface of said fixed vessel are attached so that skirt portions of the respective pin bodies of said pins are buried in said pin fitting holes.

3. The dispersing machine according to claim 1, wherein said stud bolt is made of a metal material having thermal expansion characteristics equivalent to those of said sintered hard alloy of said pin body.

4. The dispersing machine according to claim 1, wherein said pin body is fixed to said stud bolt by soldering a soldering material selected from a group essentially consisting of a silver solder, brass solder, phosphor bronze solder, and other hard solders.

5. The dispersing machine according to claim 1 wherein the stud bolt at a first end is planted and at a second end has a suction hole.

6. The dispersing machine according to claim 5 wherein the suction hole extends along at least a portion of a center axis of the stud bolt.

7. A dispersing machine comprising a fixed vessel, an agitator shaft rotating at a high speed in said fixed vessel, agitating pins provided to project on both an outer circumferential surface of said agitator shaft and an inner circumferential surface of said fixed vessel, and balls loaded in said fixed vessel in advance, whereby materials supplied into said fixed vessel to be treated are dispersed and mixed by agitation by means of said balls and said agitating pins, wherein each of said agitating pins includes a stud bolt and a pin body which is made of a sintered hard alloy shaped into a capitate cylinder, and disposed so as to cover said stud bolt said pin body being fixed to said stud bolt by soldering;

pin fitting holes are formed through a wall portion of said fixed vessel so that skirt portions of the respective pin bodies of said agitating pins are fitted into said pin fitting holes;

box nut members are fixed to an outer circumferential surface of said wall portion in positions corresponding to said pin fitting holes so that said stud bolts are screwed down to said nuts; and at least said agitating pins provided to project on the inner circumferential surface of said fixed vessel are attached so that skirt portions of the respective pin bodies of said pins are buried in said pin fitting holes.

8. The dispersing machine according to claim 1 wherein the pin body has an inner diameter and the stud bolt has an outer diameter such that the inner diameter is spaced from the outer diameter.

9. The dispersing machine according to claim 7 wherein the stud bolt at a first end is planted and at a second end has a suction hole.

10. The dispersing machine according to claim 9 wherein the suction hole extends along at least a portion of a center axis of the stud bolt.

11. The dispersing machine according to claim 7 wherein the pin body has an inner diameter and the stud bolt has an outer diameter such that the inner diameter is spaced from the outer diameter.

* * * * *